US008913774B2

(12) United States Patent
Zheng

(10) Patent No.: US 8,913,774 B2
(45) Date of Patent: Dec. 16, 2014

(54) DOUBLE EARPHONE STRUCTURE AND ELECTRONIC DEVICE

(71) Applicant: Daqing Zheng, Xinjiang (CN)

(72) Inventor: Daqing Zheng, Xinjiang (CN)

(73) Assignee: Xinjiang Tiandi Group, Xinjiang (CN)

( * ) Notice: Subject to any disclaimer, the term of this patent is extended or adjusted under 35 U.S.C. 154(b) by 0 days.

(21) Appl. No.: 13/680,874

(22) Filed: Nov. 19, 2012

(65) Prior Publication Data

US 2013/0129137 A1 May 23, 2013

(30) Foreign Application Priority Data

Nov. 21, 2011 (CN) ..... 2011 1 0373293

(51) Int. Cl.
*H04R 1/10* (2006.01)
*H04R 5/033* (2006.01)

(52) U.S. Cl.
CPC ..... *H04R 1/1016* (2013.01); *H04R 5/033* (2013.01); *H04R 1/1033* (2013.01)
USPC ..... 381/380; 381/374; 381/384

(58) Field of Classification Search
CPC ..... H04R 1/1016; H04R 1/1033; H04R 5/033
USPC ..... 381/370, 374, 377, 380, 384
See application file for complete search history.

(56) References Cited

U.S. PATENT DOCUMENTS 4,646,872 A * 3/1987 Kamon et al. ..... 181/129
6,374,126 B1 * 4/2002 MacDonald et al. ..... 455/569.1
7,032,728 B2 * 4/2006 Harcourt ..... 191/12.2 R
7,436,974 B2 * 10/2008 Harper ..... 381/374
8,295,889 B2 * 10/2012 Sim ..... 455/569.1
2003/0169896 A1 * 9/2003 Kirk et al. ..... 381/370
2004/0125977 A1 * 7/2004 Hong et al. ..... 381/376
2004/0136543 A1 * 7/2004 White et al. ..... 381/74
2004/0256188 A1 * 12/2004 Harcourt ..... 191/12.2 A (Continued)

FOREIGN PATENT DOCUMENTS

EP 2346266 A2 7/2011
KR 20-0175159 Y1 3/2000
KR 200421821 Y1 7/2006
KR 20060118645 A 11/2006

OTHER PUBLICATIONS

"Tuvie design of the future", <http://www.tuvie.com/urbanears-bagis-earphones-snap-together-like-legos/>, retrieved May 11, 2011 by Internet Archive.*

(Continued)

*Primary Examiner* — Quoc D Tran
*Assistant Examiner* — Joshua A Kaufman
(74) *Attorney, Agent, or Firm* — Harness, Dickey & Pierce, P.L.C.

(57) ABSTRACT

The present invention provides a double earphone structure and an electronic device. The double earphone structure comprises a primary earphone assembly having a primary earphone rod, and a secondary earphone assembly having a secondary earphone rod which can be in snapping connection with the primary earphone rod. When desired in use, the secondary earphone rod is detached from the primary earphone rod, and the primary earphone receiver and the secondary earphone receiver can be used simultaneously so as to obtain dual-channel, stereo effect. When not in use, the secondary earphone rod is connected with the primary earphone rod via a snapping structure, so it is convenient to retract the double earphone structure into an earphone cable retracting means.

8 Claims, 2 Drawing Sheets

(56) References Cited

U.S. PATENT DOCUMENTS

| | | | | |
|---|---|---|---|---|
| 2006/0008106 | A1* | 1/2006 | Harper | 381/374 |
| 2008/0101633 | A1* | 5/2008 | Ledbetter et al. | 381/309 |
| 2008/0159579 | A1* | 7/2008 | Park | 381/370 |
| 2008/0170740 | A1* | 7/2008 | Gantz | 381/380 |
| 2008/0187162 | A1* | 8/2008 | Lee | 381/380 |
| 2008/0240486 | A1* | 10/2008 | Garcia et al. | 381/380 |
| 2010/0151922 | A1* | 6/2010 | Zheng | 455/575.1 |
| 2011/0044487 | A1 | 2/2011 | Nault | |
| 2011/0216932 | A1 | 9/2011 | Wu | |
| 2012/0114162 | A1* | 5/2012 | Zheng | 381/384 |

OTHER PUBLICATIONS

Extended European Search Report regarding Application No. 12193387.3-1910, dated Mar. 4, 2013.

Korean Office Action regarding Application No. 10-2012-0132108, dated Oct. 31, 2013. Translation provided by Dragon Intellectual Property Law Firm.

European Office Action from counterpart Application No. 12193387.3 dated Jan. 28, 2014.

* cited by examiner

DOUBLE EARPHONE STRUCTURE AND ELECTRONIC DEVICE

CROSS-REFERENCE TO RELATED APPLICATIONS

The present application claims priority to Chinese Patent Application No. CN201110373293.4, filed on Nov. 21, 2011, and entitled "DOUBLE EARPHONE STRUCTURE AND ELECTRONIC DEVICE", the entire disclosure of which is incorporated herein by reference.

FIELD OF THE INVENTION

The present invention relates to an earphone structure, in particular to a double earphone structure and an electronic device having the double earphone structure.

DESCRIPTION OF THE PRIOR ART

A mobile phone is often equipped with a pair of earphones. An external earphone the cables of which are liable to be wound and knotted is inconvenient to carry and use, so it's almost abandoned by people. This just results in huge waste of resources and environmental pollution due to the abandoned earphones around the world every year. At the same time, as people pay more and more attention to radiation hazards caused by mobile phone, the external cable earphone for mobile phone is of course supposed to be replaced by a built-in cable earphone which cable earphone is built in a mobile phone and can be used conveniently anytime and anywhere.

However, the built-in cable earphone such as "a built-in retractable earphone", the cable of "earphone cable retracting means" in the prior art relate to a single earphone and a cable of a single earphone without a solution to the problem of changing a single earphone into a double earphones which depresses the user experience.

SUMMARY OF THE INVENTION

The present invention provides a double earphone structure and an electronic device so as to enhance user experience effectively.

The present invention provides a double earphone structure, comprising: a primary earphone assembly having a primary earphone rod; and a secondary earphone assembly having a secondary earphone rod which can be in snapping connection with the primary earphone rod.

Preferably, a first snapper provided on an inner wall of the secondary earphone rod can be in engagement with a second snapper provided on an outer wall of the primary earphone rod, so as to secure the secondary earphone rod onto the primary earphone rod.

Preferably, the primary earphone rod is provided with a transmitter.

Preferably, the primary earphone rod is further provided with a switch for controlling rotation of a micro motor. The micro motor is used for driving a winding reel to rotate, so as to retract the double earphone structure.

Preferably, the primary earphone rod is further provided with an induction magnet cooperating with the other inductive components so as to control the micro motor to stop rotating.

Preferably, the primary earphone assembly further includes a primary earphone cable, a primary earphone front cover, a primary earphone steel mesh, a primary earphone rear cover and a primary earphone receiver. The secondary earphone assembly further includes a secondary earphone cable, a secondary earphone front cover, a secondary earphone steel mesh, a secondary earphone rear cover and a secondary earphone receiver.

Preferably, the secondary earphone cable directly passes into the secondary earphone rear cover and is tied in a knot and then directly connected to the secondary earphone receiver.

The primary earphone cable passes through an inner groove of the secondary earphone rod, enters into the primary earphone rod, and is then secured by a knot. Several sets of conductors are branched off from the primary earphone cable to be in connection with the receiver, the switch of the micro motor and the primary earphone receiver respectively.

Preferably, when the primary earphone rod is in snapping connection with the secondary earphone rod, the primary earphone assembly and the secondary earphone assembly are directed in opposite directions respectively.

Preferably, the first snapper is a convex structure and the second snapper is a concave structure.

The present invention further provides an electronic device comprising the double earphone structure as mentioned above.

As can be seen from the above-mentioned technical solutions, the present invention has the following beneficial effect. In the double earphone structure, the secondary earphone rod can be in snapping connection with the primary earphone rod. When desired in use, the secondary earphone rod can be detached from the primary earphone rod, and the primary earphone receiver and the secondary earphone receiver can be used simultaneously so as to obtain dual-channel, stereo effect. When not in use, the secondary earphone rod is connected with the primary earphone rod via the snaps, so it is convenient to retract the double earphone structure into an earphone cable retracting means.

DETAILED DESCRIPTION OF THE PREFERRED EMBODIMENTS

The terms used in the embodiment are for illustrative purposes only, but shall not be construed as limiting the embodiment. It should be appreciated that, although the terms "first" and "second" can be used herein to describe various components, these components shall not be limited to the terms which, however, are merely used to differentiate these components from each other. For example, the first snapper can be called as a second snapper while the second snapper can be called as a first snap, which doesn't cause to depart from the scope of the embodiment wherein the first and second snaps are both a snapping structure, but are not the same one.

It should also be appreciated that, a primary earphone assembly and a secondary earphone assembly in the embodiment shall not be limited to the terms which, however, are merely used to differentiate these components from each other. For example, without departing from the scope of the embodiment, the primary earphone assembly can be called as a secondary earphone assembly while the secondary earphone assembly can be called as a primary earphone assembly, which doesn't cause to depart from the scope of the embodiment wherein the primary earphone assembly and the secondary earphone assembly are both an earphone assembly structure, but are not the same one.

The present invention will be described in details hereinafter in conjunction with the drawings and the embodiments so that the objects, the technical solutions and the advantages of the present invention will become more apparent. Here, the illustrative embodiments and descriptions thereof are used to explain the present invention, but shall not be considered as limitations thereto.

Figure 1:
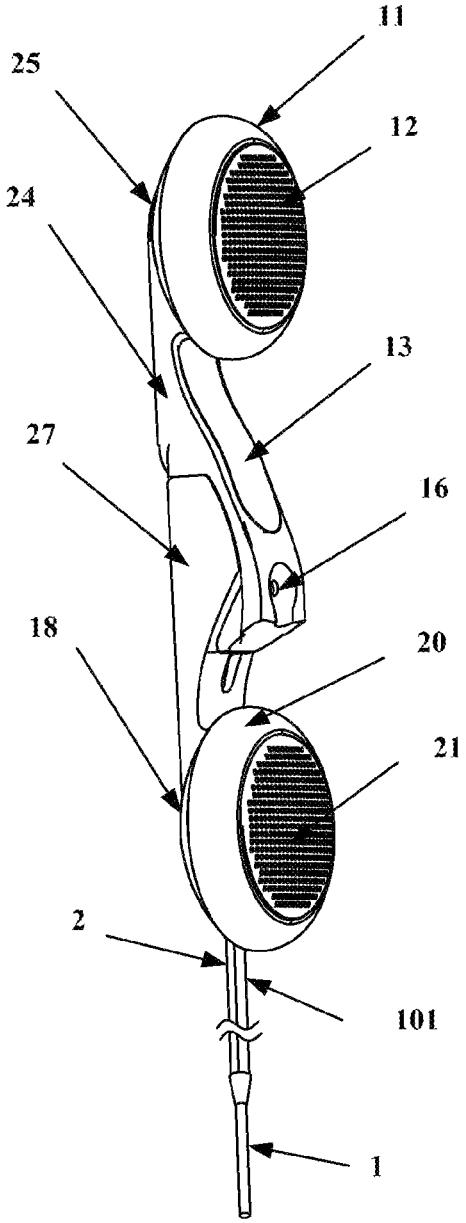
FIG. 1 is a schematic view showing a double earphone structure when a secondary earphone rod is in snapping connection with a primary earphone rod according to one embodiment of the present invention.
Figure 2:
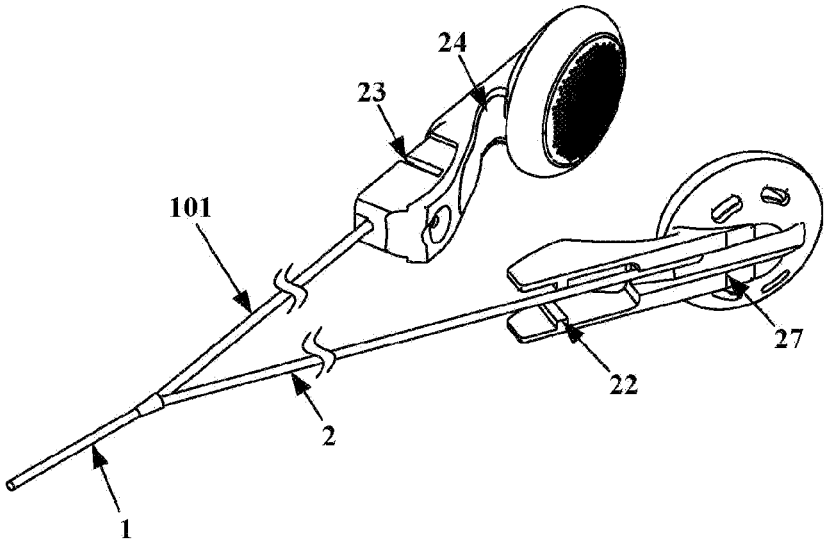
FIG. 2 is a schematic view showing the double earphone structure when the secondary earphone rod is detached from the primary earphone rod according to the embodiment of the present invention.
Figure 3:
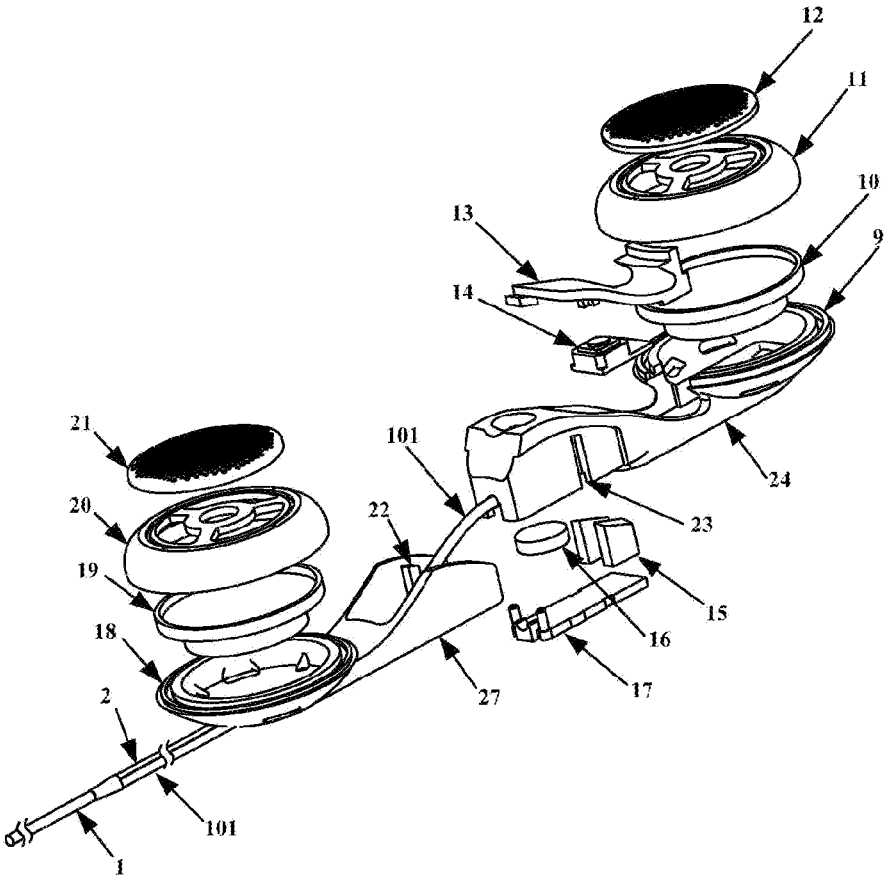
FIG. 3 is an exploded view of the double earphone structure according to the embodiment of the present invention.

As shown in FIGS. 1-3, which are schematic views showing a double earphone structure according to one embodiment of the present invention, the double earphone structure comprises: a primary earphone assembly having a primary earphone rod 24; and a secondary earphone assembly having a secondary earphone rod 27 which can be in snapping connection with the primary earphone rod 24.

As shown in FIG. 1, the primary earphone assembly comprises a primary earphone cable 101, a primary earphone front cover 11, a primary earphone steel mesh 12, a primary earphone rear cover 25, a primary earphone rod 24, a button 13 and a transmitter 16. The secondary earphone assembly comprises a secondary earphone cable 2, a secondary earphone front cover 20, a secondary earphone steel mesh 21, a secondary earphone rear cover 18, and a secondary earphone rod 27. The primary earphone cable 101 and the secondary earphone cable 2 are connected to a main earphone cable 1 respectively.

In the embodiment, the primary earphone cable 101, the main earphone cable 1 and the secondary earphone cable 2 can be provided with at least one bulletproof wire so as to prevent the earphone cables from winding and knotting.

In the embodiment, several insulated conductive wires with the same color can be combined into a set of conductor. For example, usually the main earphone cable 1 includes four to six sets of conductors, and the secondary earphone cable 2 includes two sets of conductors. Different sets of conductors can be in different colors.

In the embodiment, each of the four to six sets of conductors in the main earphone cable 1 consists of two to eight insulated conductive wires with the same color. The insulated conductive wires are arranged uniformly and in parallel to each other, and wound to the same bulletproof wire in the main earphone cable 1.

Each of the two sets of conductors in the secondary earphone cable 2 consists of two to eight insulated conductive wires with the same color. The insulated conductive wires are arranged uniformly and in parallel to each other, and wound to the same bulletproof wire in the secondary earphone cable 2.

For instance, the primary earphone cable 101 comprises four sets of conductors, two of which can be used for transmitting an audio signal to the receiver, one of which can be used for transmitting a voice signal from the transmitter, and one of which can be used for outputting a control signal to a micro motor.

As shown in FIG. 2, a first snapper 22 provided on an inner wall of the secondary earphone rod 27 is inserted into and engaged with a second snapper 23 provided on an outer wall of the primary earphone rod 24, so that the secondary earphone rod 27 and the primary earphone rod 24 are secured by snapping connection; and vice versa. With the arrangement of the first snapper 22 on the inner wall of the secondary earphone rod 27 and the second snapper 23 on the outer wall of the primary earphone rod 24, the room occupied by the double earphone structure after the secondary earphone rod 24 is in snapping connection with the primary earphone rod 27 can be effectively reduced.

Furthermore, in order to facilitate the retraction of the double earphone structure and to use the secondary earphone receiver or the primary earphone receiver of the double earphone structure directly under the snapping state, the secondary earphone rod 27 can be snapped into the primary earphone rod 24 in opposite directions in this embodiment, so that the primary earphone assembly and the secondary earphone assembly are directed in different directions (e.g., directed in opposite directions), as shown in FIG. 1.

By means of the snapping structure, the appearance of the double earphone structure can be viewed as a whole, and the secondary earphone assembly and the primary earphone assembly can be assembled or disassembled quickly.

In the embodiment, a convex structure (the first snapper 22) is provided on the inner wall of the secondary earphone rod 27, and a concave structure (the second snapper 23) is provided on the outer wall of the primary earphone rod 24. The concave structure on the primary earphone rod 24 can be in engagement with the convex structure on the secondary earphone rod 27, so as to secure the secondary earphone rod 27 onto the primary earphone rod 24 to form the double earphone structure, as shown in FIG. 2.

It should be appreciated that the detailed structures of the first snapper 22 and the second snapper 23 are not limited in the embodiment.

When only a single earphone is needed in the use, the double earphone structure can be considered as a whole, e.g., the secondary earphone receiver or the primary earphone receiver can be put into an ear. At this time, it is unnecessary to detach the primary earphone assembly and the secondary earphone assembly from each other.

When double earphones are desired to be used, the secondary earphone assembly can be detached from the primary earphone assembly, e.g., the secondary earphone rod 27 can be detached from the primary earphone rod 24 to form double earphones that can be used simultaneously, as shown in FIG. 2.

Referring to FIG. 3, which is an exploded view of the double earphone structure according to the embodiment of the present invention, the primary earphone assembly comprises a primary earphone rear cover 9, a primary earphone receiver 10, a primary earphone front cover 11, a primary earphone steel mesh 12, and a primary earphone rod 24. The primary earphone assembly further comprises a button 13, a switch 14 of a micro motor, an induction magnet 15, a transmitter 16, a primary earphone rear seal 17 and a second snapper 23.

In the embodiment, the transmitter 16 is arranged on the primary earphone rod 24 so that a user can answer a call when using the double earphone structure. Due to the arrangement of the transmitter 16 on the primary earphone rod 24, there is not any obstacle when the main earphone cable 1, the primary earphone cable 101 and the secondary earphone cable 2 is retracted by the retracting means.

In the embodiment, the switch 14 of the micro motor can be triggered into an ON state by pressing the button 13, so as to control the micro motor to rotate. The micro motor can drive a winding reel to retract the double earphone structure. When releasing the button 13, the switch 14 of the micro motor can be triggered into an OFF state so as to control the micro motor to stop rotating. Further, the switch 14 is arranged on the primary earphone rod 24 so as to facilitate operation of the user.

In the embodiment, the induction magnet 15 can be used for inductive control of the micro motor in the earphone cable retracting means. The induction magnet 15 can cooperate with other inductive components to control the micro motor to stop rotating, thereby to prevent the micro motor from rotating after the retraction of the double earphone structure is completed. For example, when the primary earphone rod 24 provided with the induction magnet 15 is retracted into a housing of an electronic device, the induction magnet 15 can cooperate with the other inductive components so as to control the micro motor to stop rotating.

The secondary earphone assembly comprises a secondary earphone rear cover 18, a secondary earphone receiver 19, a secondary earphone front cover 20, a secondary earphone steel mesh 21, and a secondary earphone rod 27. Also, the first snapper 22 is arranged on the secondary earphone rod 27.

In the embodiment, the secondary earphone cable 2 can include two sets of conductors connected to positive and negative poles of the secondary earphone receiver 19 respectively. The primary earphone cable 101 usually includes three, four or five sets of conductors connected to positive and negative poles of the primary earphone receiver 10, positive and negative poles of the transmitter 16, and the switch 14 of the micro motor respectively.

As shown in FIG. 3, the double earphone cables pass through a slot of the secondary earphone rear cover. The secondary earphone cable 2 directly passes into the secondary earphone rear cover 18 and is tied by a knot and then directly connected to the secondary earphone receiver 19. The primary earphone cable 101 passes through an inner groove of the secondary earphone rod, enters into the primary earphone rod, and is then secured by a knot. Several sets of conductors are branched off from the primary earphone cable to be in connection with the transmitter 16, the switch 14 of the micro motor and the primary earphone receiver 10 respectively.

As can be seen from the above-mentioned technical solutions, the present invention has the following beneficial effects. In the double earphone structure according to this embodiment, the secondary earphone rod can be in snapping connection with the primary earphone rod. When desired in use, the secondary earphone rod can be detached from the primary earphone rod, and the primary earphone receiver and the secondary earphone receiver can be used simultaneously so as to obtain dual-channel, stereo effect. When not in use, the secondary earphone rod is connected with the primary earphone rod via a snapping structure, so it is convenient to retract the double earphone structure into an earphone cable retracting means.

The present invention further provides an electronic device which comprises the double earphone structure as described above.

It should be appreciated that the electronic device can be a mobile phone, a tablet computer, a mobile computer or a navigator.

The above is merely a preferred embodiment of the present invention. It should be noted that, a person skilled in the art can make further improvements and modifications without departing from the principle of the present invention, and these improvements and modifications shall also be considered as the scope of the present invention.

What is claimed is:

1. A double earphone structure, comprising:

a primary earphone assembly having a primary earphone rod; and a secondary earphone assembly having a secondary earphone rod which can be in snapping connection with the primary earphone rod when the primary earphone rod is in snapping connection with the secondary earphone rod, the primary earphone assembly and the secondary earphone assembly are directed in opposite directions respectively, and the primary earphone assembly and the secondary earphone assembly are at the same level of height; the primary earphone rod and the secondary earphone rod are connected to form an integral structure so that the double earphone structure can be retracted into an earphone cable retracting means;

wherein the primary earphone rod is provided with a transmitter;

wherein the primary earphone rod is further provided with a switch;

wherein the primary earphone assembly further comprises a primary earphone cable, a primary earphone front cover, a primary earphone steel mesh, a primary earphone rear cover and a primary earphone receiver; and the secondary earphone assembly further comprises a secondary earphone cable, a secondary earphone front cover, a secondary earphone steel mesh, a secondary earphone rear cover and a secondary earphone receiver;

wherein the secondary earphone cable directly passes into the secondary earphone rear cover and is knotted and then directly connected to the secondary earphone receiver; and the primary earphone cable passes through an inner groove of the secondary earphone rod, enters into the primary earphone rod, and is then knotted to secure, and several sets of conductors of the primary earphone cable are branched off from the primary earphone cable to be in connection with the receiver, the switch and the primary earphone receiver respectively.

2. The double earphone structure according to claim 1, wherein a first snapper provided on an inner wall of the secondary earphone rod can be in engagement with a second snapper provided on an outer wall of the primary earphone rod, so as to secure the secondary earphone rod onto the primary earphone rod.

3. The double earphone structure according to claim 2, wherein the first snapper is a convex structure and the second snapper is a concave structure.

4. An electronic device, comprising the double earphone structure according to claim 3.

5. An electronic device, comprising the double earphone structure according to claim 2.

6. The double earphone structure according to claim 1, wherein the primary earphone rod is further provided with an induction magnet.

7. An electronic device, comprising the double earphone structure according to claim 6.

8. An electronic device, comprising the double earphone structure according to claim 1.

* * * * *